US009017222B2

(12) United States Patent
Hofeldt et al.

(10) Patent No.: US 9,017,222 B2
(45) Date of Patent: Apr. 28, 2015

(54) MACHINE FOR TESTING AND TRAINING JUMPING AND REACHING ABILITY

(76) Inventors: Robert Herman Hofeldt, Littleton, MA (US); Albert John Hofeldt, Miami Beach, FL (US)

( * ) Notice: Subject to any disclaimer, the term of this patent is extended or adjusted under 35 U.S.C. 154(b) by 208 days.

(21) Appl. No.: 12/930,516

(22) Filed: Jan. 10, 2011

(65) Prior Publication Data

US 2012/0178587 A1 Jul. 12, 2012

(51) Int. Cl.
*A63B 21/00* (2006.01)
*A63B 5/00* (2006.01)
*A63B 69/00* (2006.01)

(52) U.S. Cl.
CPC ..... *A63B 5/00* (2013.01); *A63B 69/0071* (2013.01); *A63B 69/0095* (2013.01)

(58) Field of Classification Search
USPC ..... 482/15, 71, 35
See application file for complete search history.

(56) References Cited

U.S. PATENT DOCUMENTS

| | | | | |
|---|---|---|---|---|
| 825,860 | A * | 7/1906 | McKenzie | 482/90 |
| 4,932,137 | A * | 6/1990 | Haley et al. | 33/700 |
| 5,031,903 | A * | 7/1991 | Clarke | 482/148 |
| 5,072,931 | A * | 12/1991 | Carlson | 482/15 |
| 5,803,876 | A * | 9/1998 | Hickman | 482/72 |
| 7,955,222 | B1 * | 6/2011 | Hernandez | 482/14 |
| 2009/0023557 | A1 * | 1/2009 | Underwood | 482/15 |

* cited by examiner

*Primary Examiner* — Jerome w Donnelly

(57) ABSTRACT

A machine for testing and training jumping and reaching ability for use by athlete or by other people for recreation is disclosed having the following attributes: centrally balanced, light weight and portable, usable indoors or outdoors, resets to starting position after each use, signals contact by flashing light or sound, and has means of measuring the height reached by the extended hand.

8 Claims, 16 Drawing Sheets

MACHINE FOR TESTING AND TRAINING JUMPING AND REACHING ABILITY

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of athletic equipment and more specifically to a machine for testing and training jumping and reaching ability.

Reaching, the standing jump and the running jump are attributes of an athlete, particularly for volleyball, basketball, tennis, and football, to name a few sports. By testing jumping ability can be measured and compared over time for the same individual or compared to other players. With training jumping ability can be improved.

A commonly used jump tester is the Wall-Mounted Vertical Jump Board which comes in two forms, one uses Velcro and the other one uses magnetism for attaching marking indicators. A board with a linear scale is attached to a wall. The subject jumps and attaches a hand held adhesive or magnetic marker to the wall board. Disadvantages of these boards are (1) the inability to use for a running jump, (2) the hand held marker requires flexing the fingers away from the vertical which does not allow a full reach measurement, (3) the need to retrieving the adhesive or magnetic marker from the board, and (4) a stationary wall is required to attach the board.

The tester used by large organizations is the Vertec jump testing device (U.S. Pat. No. 5,031,903). It consists of adjustable movable color-coded multiple movable vanes to measure vertical reach. The device weighs 55 lbs and mounts to a steel base that is secured with 10 lbs weights or bolted to a wall with a metal plate. Disadvantages are (1) a designated area is required because it is heavy, large, and has many parts, (2) requires manual resetting the vanes after each use, and (3) is costly.

Time elapse measurement is another method of measuring the vertical jumping height. Vertical jump measuring device (U.S. Pat. No. 6,181,647) describes using switches (transducers) to measure the time from the beginning to the end of a jump. The square of the in-air time is multiplied by a constant to derive vertical jump height and the height is displayed. Disadvantage of this method is (1) the flexing position of the legs and body in not taken into account and this can influence the time/height relationship, (2) to determine the vertical jump reach, one must also measure the standing height of the jumper and add this to the jump height measured, and (3) electronic components that require calibration measurements.

None of the current jump testers and trainers fulfills all of the following attributes of an ideal jump tester and trainer: (1) the ability to measure standing and jumping reach, (2) readily portable, (3) useable indoors and outdoors, (4) requiring no designated space or wall support, (5) requires no resetting or adjustments after each use, and (6) requires no calibration.

BRIEF SUMMARY OF THE INVENTION

In accordance with a preferred embodiment of the invention, there is disclosed a jumping and training device comprising a contact arm set at an altitude for the athlete to attempt to reach and make contact. The contact arm is supported by a vertical shaft and a stand. Because the contact arm is centrally balanced, the vertical shaft and stand can be of light weight construction and this makes the device easily portable and mountable to a floor stand, to a spike driven to the terrain, to a gym floor receptacle, and to the antenna of volleyball net. The height of the contact arm is measured by a linear scale marked on the telescoping vertical shaft, a retractable tape, or by an electronic ruler. Successful jumping and reaching is signaled by movement of the contact arm and/or activation of an electronic motion sensor with the emission of light or sound.

Embodiments having different means of movement after being struck by a force are described and including flexing contact arm, flexing hinge contact arm, rotating hinge contact arm, revolving contact arm, and revolving contact arm with rotation governed by magnetic force or mechanical stops.

BRIEF DESCRIPTION OF THE DRAWINGS

The drawings constitute a part of the specifications and include exemplary embodiments to the invention, which may be embodied in various forms. It is to be understood that in some instances various aspects of the invention may be shown exaggerated or enlarged to facilitate an understanding of the invention.

DETAILED DESCRIPTION OF INVENTION

Figure 2:
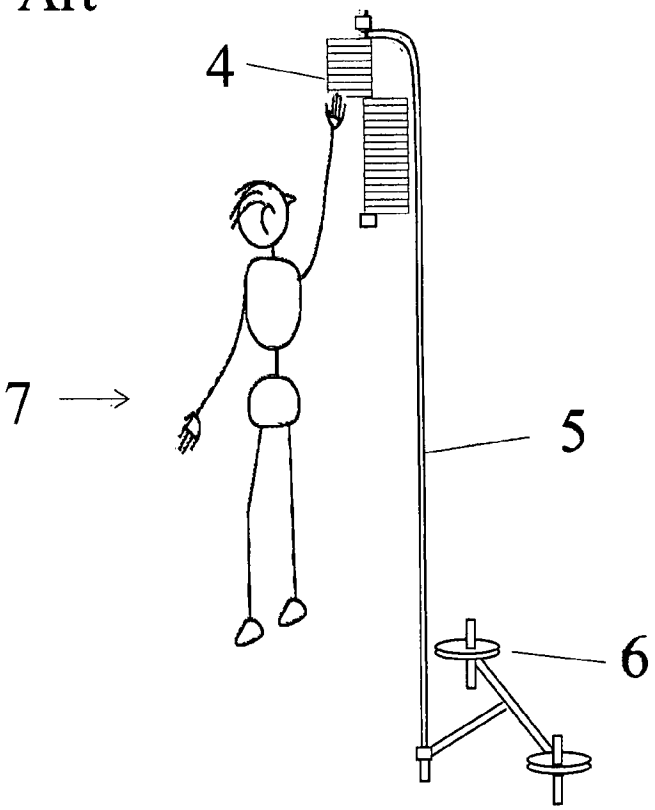
Prior Art FIG. 2
FIG. 2. Shows the Vertec Jumper.
Figure 1:
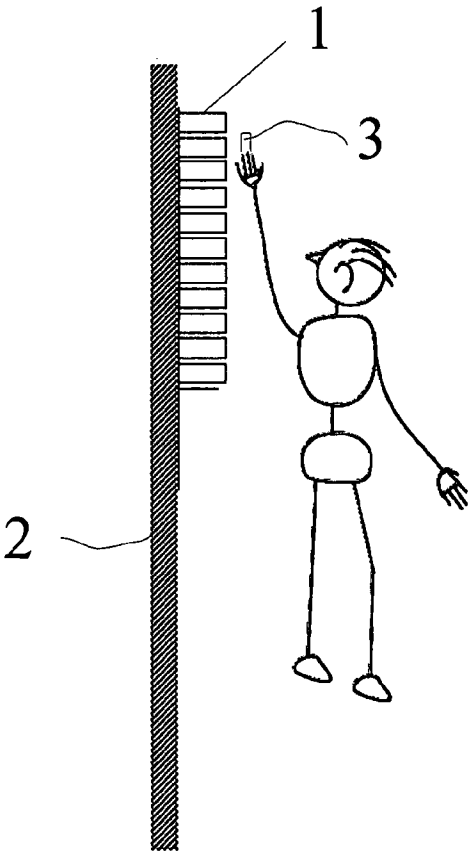
FIG. 1. Shows prior art of wall-mounted Vertical Jump Board.

Detailed descriptions of the preferred embodiment are provided herein. It is to be understood, however, that the present invention may be embodied in various forms. Therefore, specific details disclosed within are not to be interpreted as limiting, but rather as a basis for the claims and as a representative basis for teaching one skilled in the art to employ the present invention in virtually any appropriately detained system, structure or manner. FIGS. 1 and 2 are prior art illustrating currently available equipment for testing and training the jumping reach. Wall-mounted Vertical Jump Board 1 in FIG. 1 requires wall 2 for mounting and the subject must attach Marker 3 to Vertical Jump Board 1 to document the height reached by the subject. Depending upon design, marker 3 attaches by Velcro® adhesion or by magnetism. The device is not favorable for running jumps due to the close proximity of the jumping subject to wall 2. FIG. 2 depicts the Vertec Jumper 7 which is bulky due to the heavy gauge of support stand 5 and counter weights 6 needed to stabilize and balance numerous off-centered vanes 4. Vanes 4 require manual repositioning after use. Due to the size, weight and configuration of Vertec Jumper 7, a designated space is generally required since it cannot be readily disassembled and reassembled.

Figure 4:
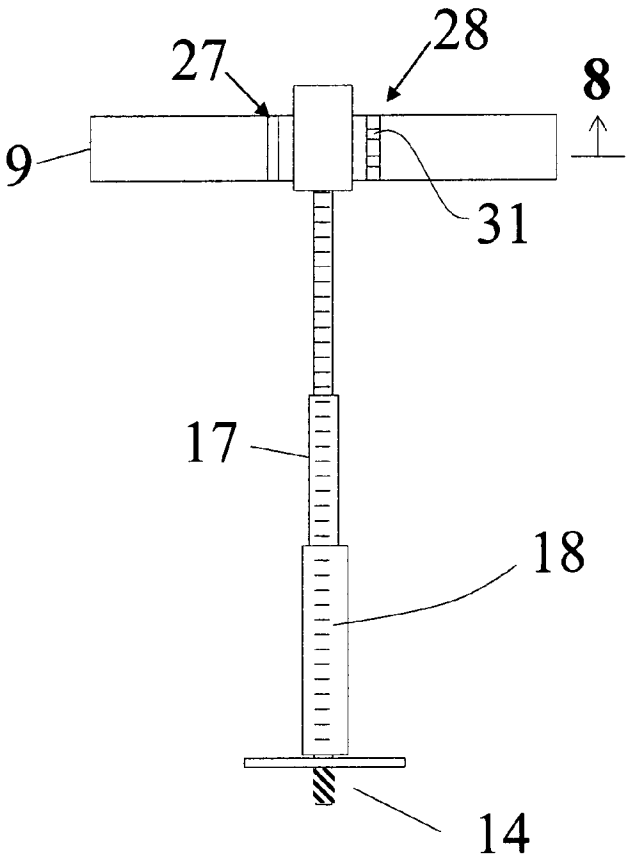
FIG. 4. Shows in frontal view the contact arms with flexing hinges, the linear height scale, the adjustable shaft, and the bolt for floor mounting.
Figure 3:
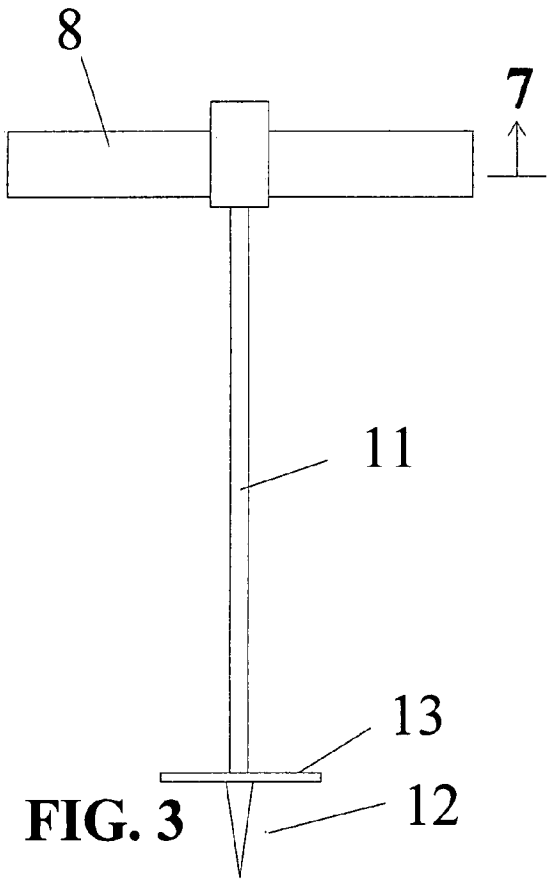
FIG. 3. Shows in frontal view the centrally balanced contact arm, the vertical shaft, and the base.
Figure 5B:
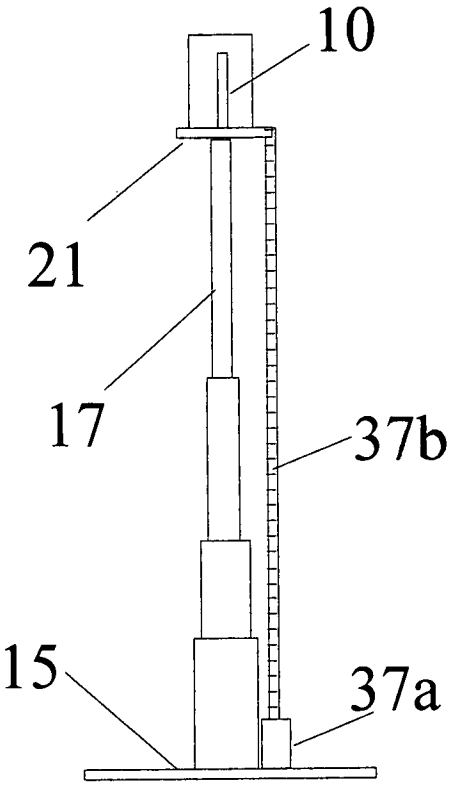
FIG. 5B. Shows in side view the retractable measuring tape connecting between the base and the reflection plate of the contact arm.
Figure 5A:
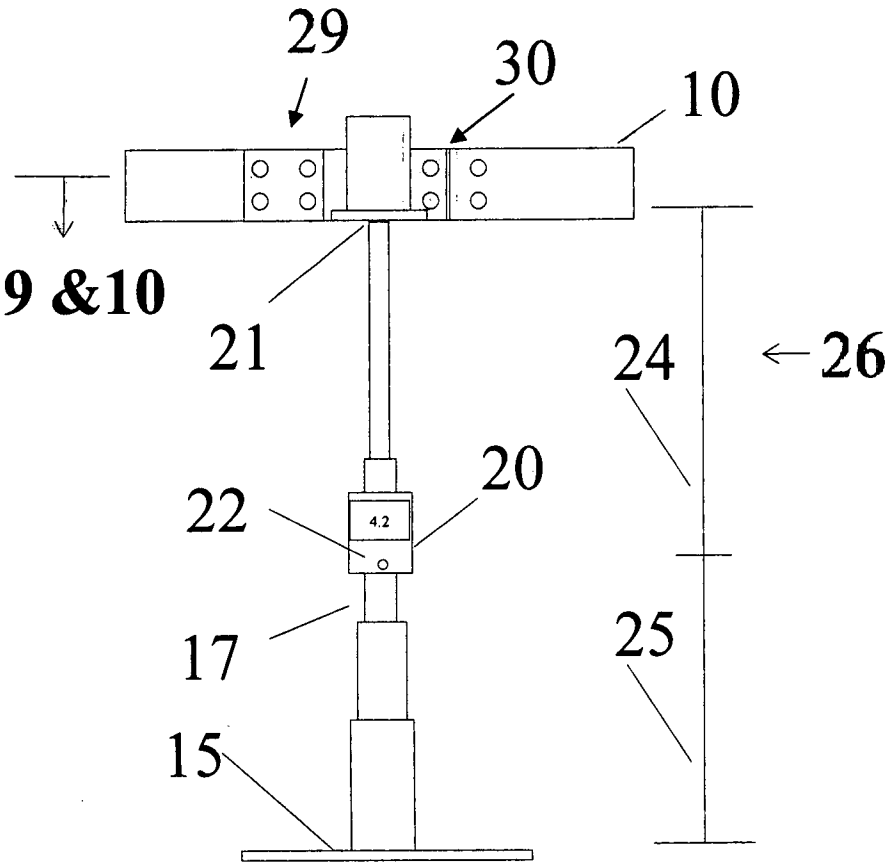
FIG. 5A. Shows in frontal view the contact arms with flexing hinges, the electronic ruler, and the floor stand.
Figure 6:
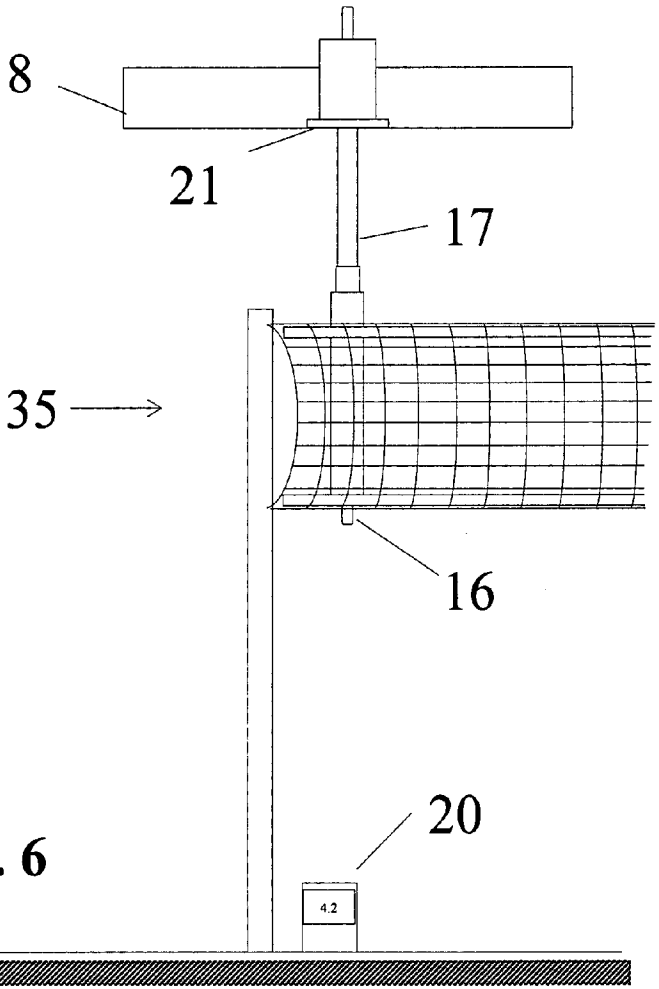
FIG. 6. Shows in frontal view our invention mounted over the antenna of a volleyball net using a hollow shaft.

The basic elements of our invention can be viewed in FIG. 3 and consists of contact arm 8 for signaling hand contact of a successful jumping reach, vertical shaft 11 positioned perpendicularly to and supporting contact arm 8 at an altitude, and a base to maintain vertical shaft 11 erect, such as, spike 12 with optional stabilizing plate 13. Contact arm 8 may be rotatable or non-rotatable as will be disclosed by our various embodiments. A key feature of the invention is the central balance design which eliminates the need for heavy and bulky support weights to maintain a stable upright position. Because the invention is centrally balanced, minimal support is required and vertical shaft 11 can be hollow and anchored in the earth by stake 12, by a gym floor receptacle with treaded bolt 14 as shown in FIG. 4, by floor stand 15 as shown in FIG. 5, or slide over volleyball net antenna 16 as shown in FIG. 6. Adjustable shaft 17 in FIGS. 4, 5A, 5B, and 6 provides for easy adjustment of the height of contact arms 8, 9, and 10. Height measurement is achieved by linear scale 18 marked on adjustable shaft 17 as illustrated in FIG. 4, by commercially available electronic ruler 20 utilizing light or sound waves as illustrated in FIG. 5A, or retractable tape 37*a* in FIG. 5B. To determine altitude 26 of contact arm 10, distance 24 and 25 are measured with electronic ruler 20 and summated. Distance 24 is measured by aligning the measuring beam of electronic ruler 20 with reflection plate 21. Distance 25 is measured by rotating electronic ruler 20 by 180 degrees around pivot bolt 22 and measuring the distance to floor stand 15. When our invention is mounted over the antenna of volleyball net 35 as seen in FIG. 6, electronic ruler 20 is placed on the terrain surface and a measurement is taken to plate 21, the altitude of contact arm 8. In FIG. 5B is tape measure housing 37*a* attached to stand 15 with recoiling tape 37*b* extended and attached to plate 21. Recoiling tape 37*b* extends or recoils as adjustable shaft 17 is lengthened or shortened.

Figure 9:
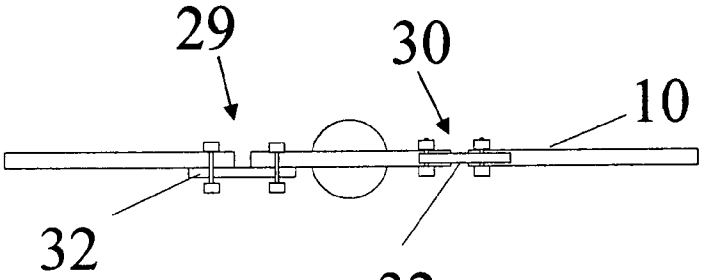
FIG. 9. Shows in cross-sectional view the contact arm with flexing hinges of FIG. 5.
Figure 10:
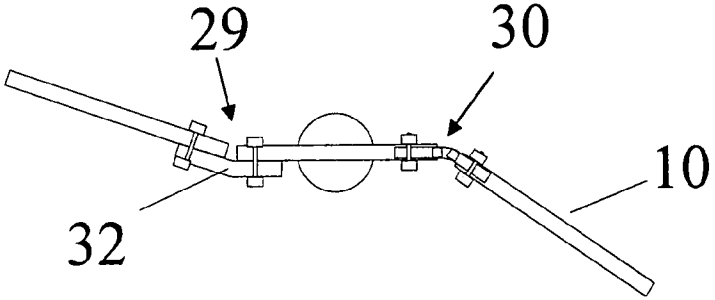
FIG. 10. Shows in cross-sectional view the contact arm with flexing hinges of FIG. 5 stretched by force.
Figure 7:
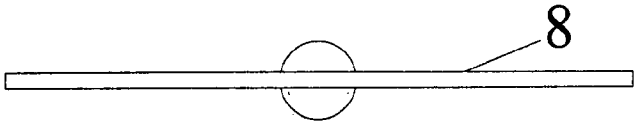
FIG. 7. Shows in cross-sectional view the contact arm of FIG. 3.
Figure 8:
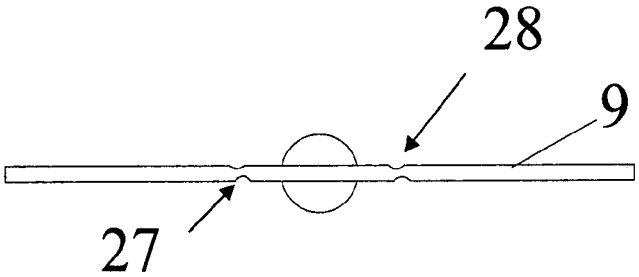
FIG. 8. Shows in cross-sectional view the contact arm with flexing hinges of FIG. 4.
Figure 11:
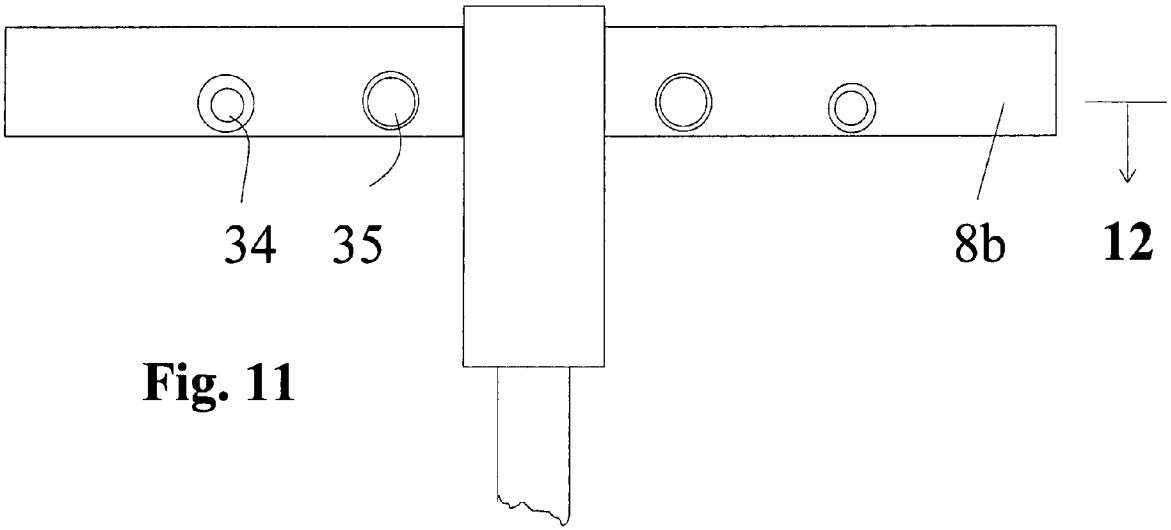
FIG. 11. Shows in frontal view ports housing lights and/or speaker for signaling movement of the contact arm triggered by a motion sensor.

Contact arm 9 in FIGS. 4 and 8 is non-rotatable and made of a material that bends easily when hit and readily straightens to reposition to the starting position. The strength and flexibility of contact arm 9 can be varied by the choice of material, the dimensions of the material and the application of hinges. Hinges located close to or adjacent to adjustable shaft 17 further increase the flexibility of contact arm 9 by thinning the material with grooves as illustrated by hinge 27 of contact arm 9 in FIGS. 4 and 8, by adding perforation 31 as illustrated by hinge 28 of contact arm 9 in FIG. 4, by bridging a cleavage with a more flexible material as illustrated with contact arm 10 by hinge 29 and hinge 30 as shown in FIGS. 5A, 9 and 10 where material 32 bridges externally in hinge 29 and internally with a tongue and groove configuration in hinge 30. Material 32 may be plastic, elastic, rubber, or another flexible substance.

Figure 12:
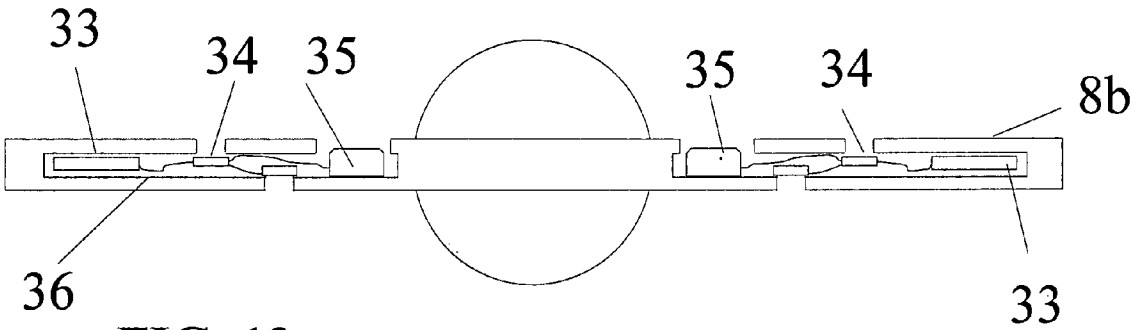
FIG. 12. Shows FIG. 11 in cross-sectional view.

Observing motion of contact arm 8-10 is one method of signaling a successful jumping reach. To better signal a successful jumping reach, motion sensor 33 as illustrated in FIG. 12 is incorporated into contact arm 8*b* and connected to light 34 and/or speaker 35. With motion of contact arm 8*b* by a successful hit, motion sensor 33 generates an electrical impulse that passes through circuit 36 to illuminate light 34 and sound speaker 35. Flasher 39 illustrated in FIGS. 14, 15A-16C has lights, sensor and battery integrated is a single unit.

Figure 13:
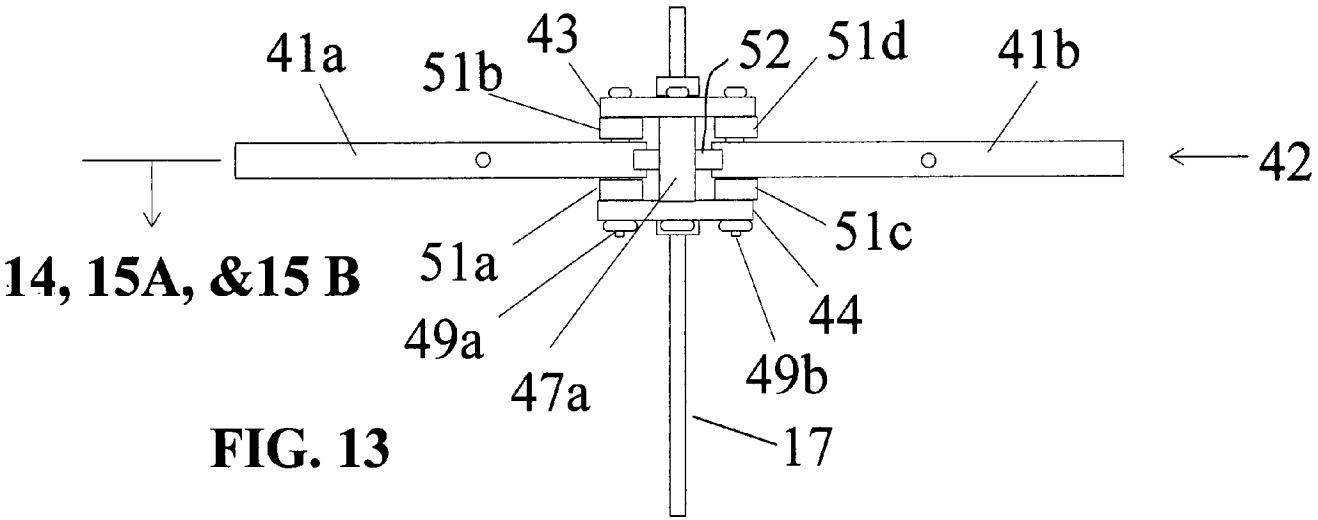
FIG. 13. Show in frontal view the contact arms having a top and bottom plate and rotatable hinges.
Figure 14:
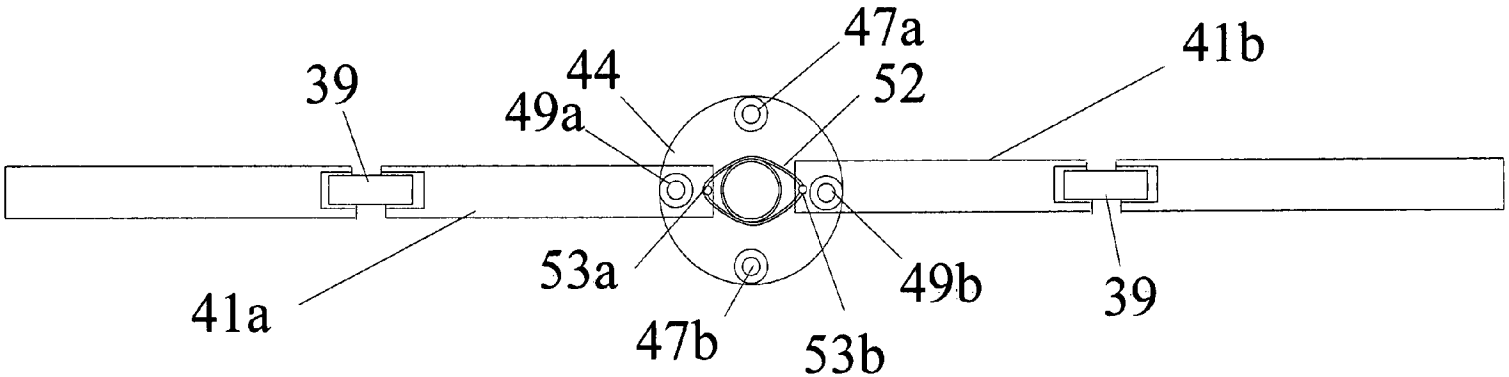
FIG. 14. Shows in cross-sectional view the contact arms of FIG. 13 having a single elastic spring connecting between the proximal ends two contact arms.
Figure 15A:
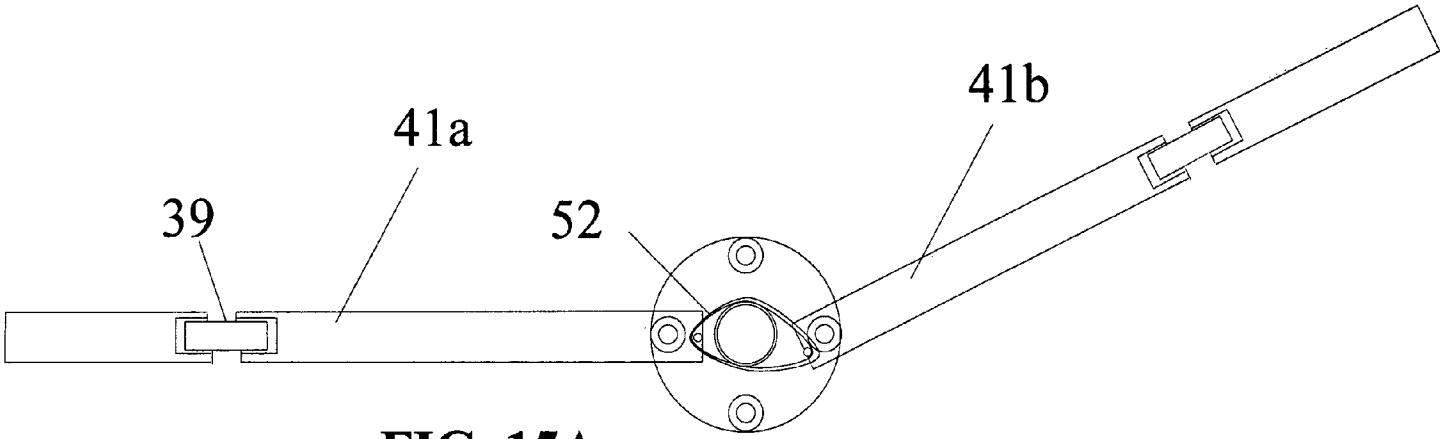
FIG. 15A. Shows in cross-sectional view the contact arms of FIG. 14 with elastic spring stretched by the movement of one contact arm from the starting position.
Figure 15B:
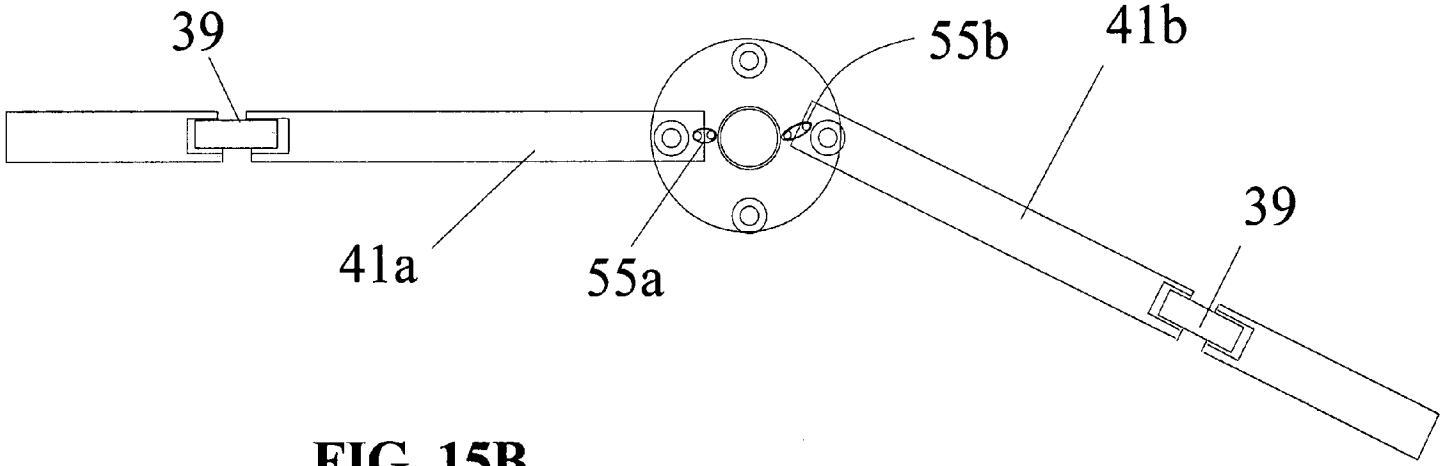
FIG. 15B. Shows in cross-sectional view the contact arms having rotatable hinges with a separate spring connecting to the proximal end of each contact arms.

An alternative to flexing hinges are rotating hinges as illustrated in FIGS. 13-16C. As seen in FIG. 13, rotatable hinge 42 consists of first contact arm 41*a* and second contact arm 41*b* positioned on opposite sides of adjustable shaft 17. Rotatable contact arms 41*a* and 41*b* pivot around hinge bolts 49*a* and 49*b*, respectively. Loosely fitting hinge bolts 49*a* and 49*b* and spacer 51*a*, 51*b*, 51*c* and 51*d* provide for free rotation of contact arms 41*a* and 41*b*. Shoulder bolts 47*a* and 47*b* are seen in FIG. 14 securely fastens top plate 43 to bottom plate 44. Elastic band 52 seen in FIGS. 14 and 15A spanning between the proximal ends of first contact arms 41*a* and second contact arm 41*b* is secured to first contact arm 41*a* and second contact arm 41*b* by bolts 53*a* and 53*b*, respectively. As illustrated in FIG. 15A, when contact arm 41*a* or 41*b* is moved from the resting position by force, elastic band 52 is stretched. The potential energy in stretched elastic band 52 returns contact arms 41*a* and 41*b* back to the starting position. Rather than using single elastic band 52, recoiling springs can be attached to contact arms 41*a* and 41*b* as shown in FIG. 15B by spring 55*a* and 55*b*.

Figure 16A:
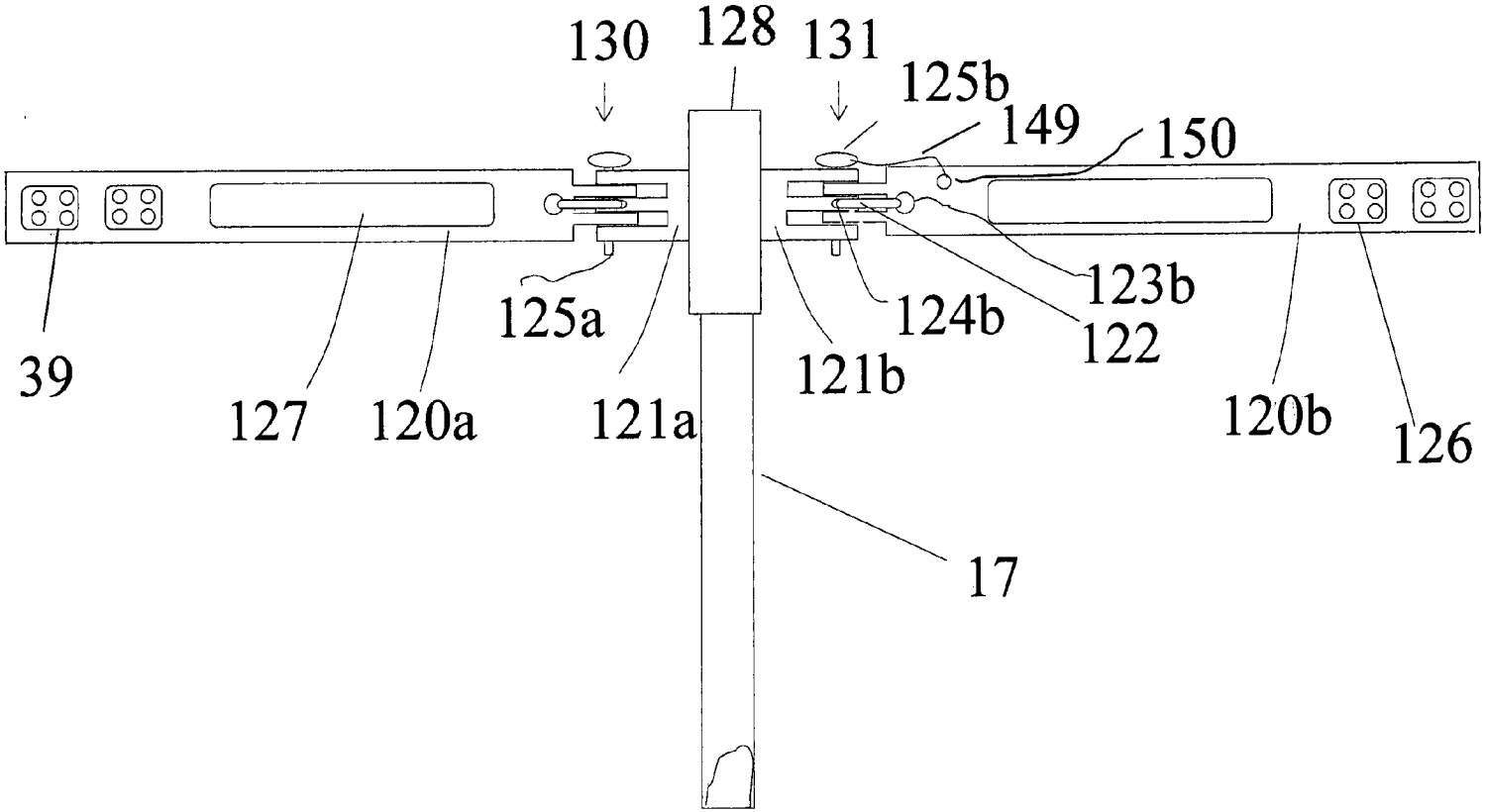
FIG. 16A. Shows in frontal view the preferred embodiment having side supports and rotatable hinges.
Figures 16B, 16C:
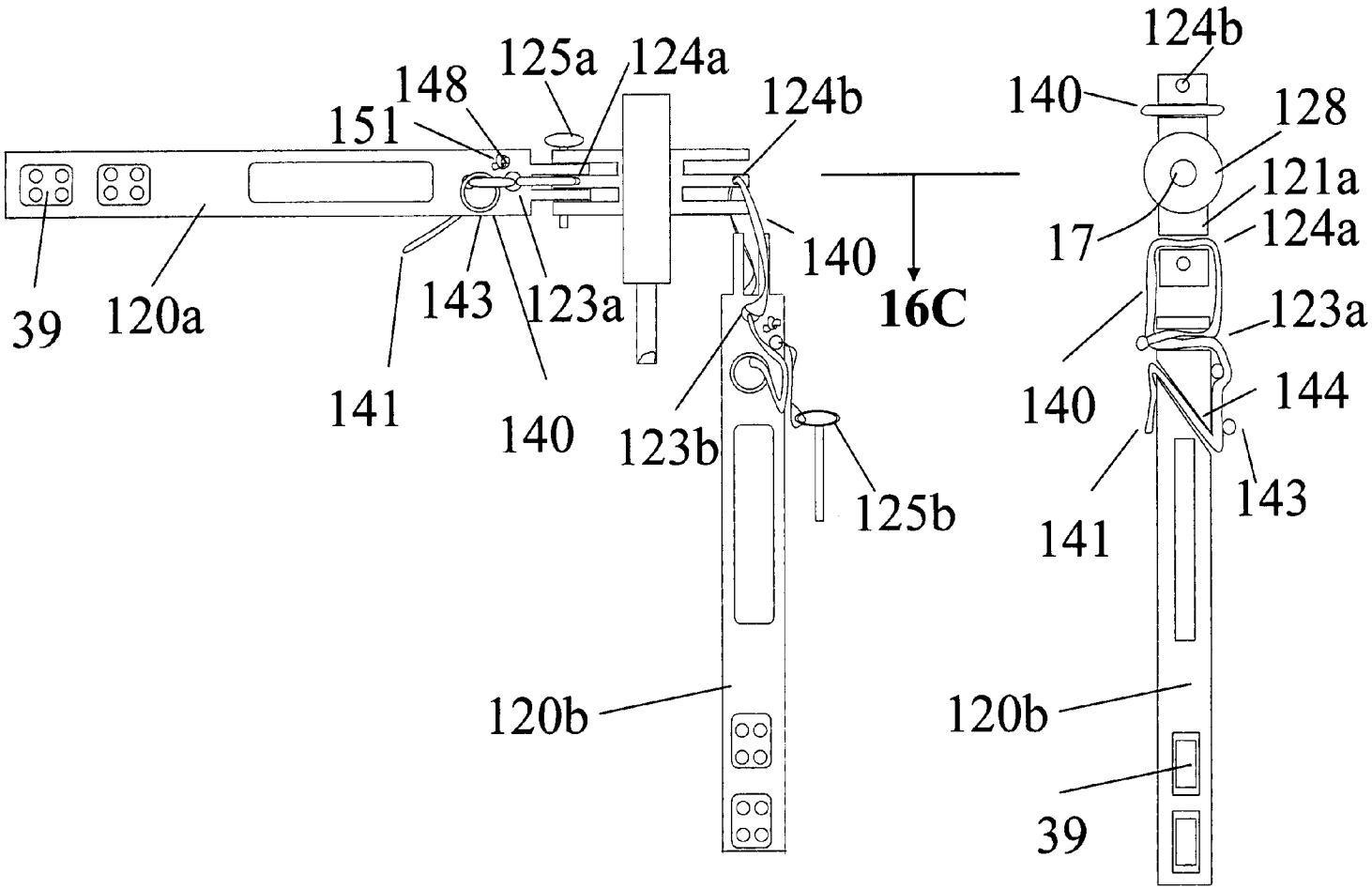
FIG. 16B. Shows in frontal view the preferred embodiment with the serpentine adjustable tension cord.
FIG. 16C. Shows the rotating contact arm in cross-sectional view and the course of the serpentine adjustable tension cord.
Figure 19:
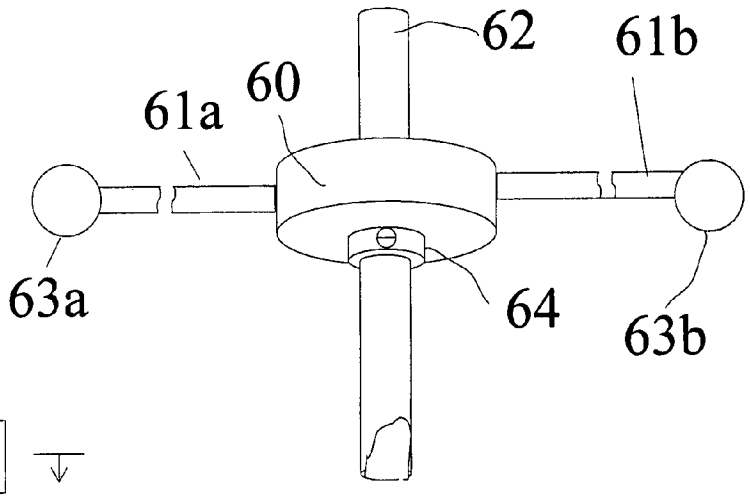
FIG. 19. Shows in a frontal perspective view the revolving contact arms.
Figure 18:
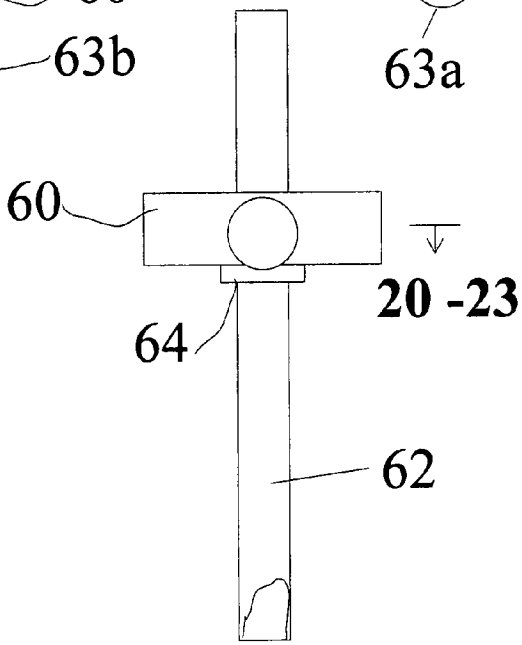
FIG. 18. Shows in side view the revolving contact arms.
Figure 17:
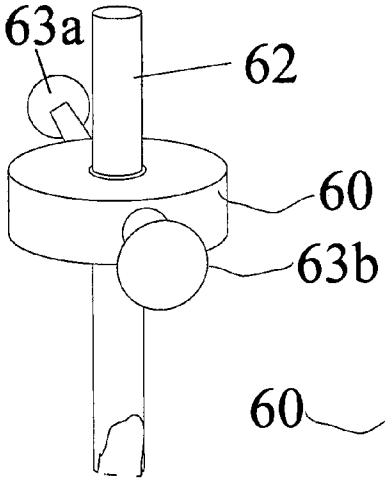
FIG. 17. Shows the revolving contact arms in perspective view from above.

In FIGS. 16A-16C is our preferred embodiment showing central support 128 that mounts over adjustable shaft 17 with side support arms 121*a* and 121*b* attaching to central support 128. Side support 121*a* and contact arm 120*a* are attached by pin 125*a* to form hinge 130 and side support 121*b* and contact arm 120*b* are attached by pin 125*b* to form hinge 131. Retaining leash 149 secures pin 125*b* to hole 150. A recoiling element, such as, elastic cord 122 passes through holes 123*b* and 124*b* to bridge between side support 121*b* and contact arm 120*b*. Elastic cord 122 when stretched by a hit generates a force that returns contact arm 120*b* to the starting position. Contact arms 120*a* and 120*b* may contain flashing motion sensors to signal a successful hit, such as, flashing sensor 126 and may have perforations such as perforation 127 that reduce the mass of the arm and lowers air resistance to promote ease of contact arm movement. In FIGS. 16B and 16C is illustrated serpentine cord 140 which is elastic and serves to return contact arms 120*a* and 120*b* to the starting position following a hit. By sliding cord 140 through channel 144 as seen in FIG. 16C, the tension of cord 140 can be adjusted. The acute angle between the surface of contact arm 120*a* and channel 144 prevents cord 140 from slipping when cord 140 is taut and this maintains the desired tension of cord 140. The course of cord 140 can be better visualizing by viewing FIGS. 16B and 16C. Starting at knot 148 in FIG. 16B, cord 140 passes through holes 151 and 123*a* in contact arm 120*a*, through hole 124*a*, back through hole 123*a*, through ring 143, and through channel 144. By pulling on ring 143, cord 140 can be loosened in order to firmly grasp and pull cord 140 to adjust the tension. For portability, pin 125*a* and 125*b* can be removed to separate contact arms 120*a* and 120*b* from side supports 121*a* and 121*b*. FIG. 16B illustrates cord 140 tethering contact arm 120*b* when pin 125*b* is removed.

Figure 21:
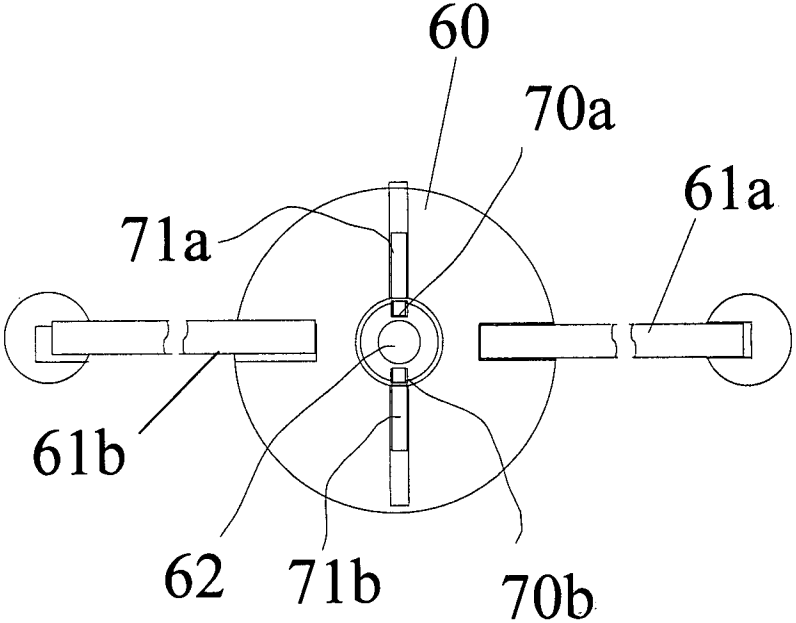
FIG. 21. Shows FIG. 20 in the cross-sectional view with the contact arms rotated by 90 degrees and the magnets in alignment for maximum attraction, the position that occurs when rotation stops.
Figure 20:
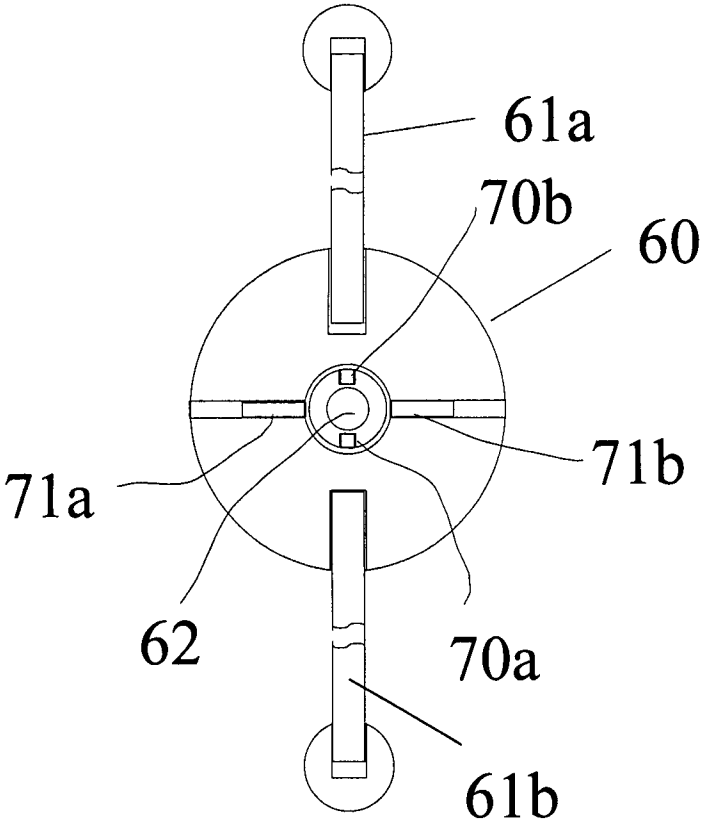
FIG. 20. Shows FIG. 18 in cross-sectional view with the alignment of the magnetic rotational governance magnets in the preparatory position for hitting.

Another embodiment of our invention having a revolving mechanism is illustrated in FIGS. 17-29. In FIGS. 17-23, rotary head 60 with attached contact arms 61*a* and 61*b* revolves around the vertical supporting shaft 62. Retaining ring 64 in FIG. 19 maintains rotary head 60 at an altitude. The possibility of piercing injury while performing the jumping reach is prevented by optional blunt ends 63*a* and 63*b* of contact arms 61*a* and 61*b*, respectively. Rotary head 60 may revolve freely around shaft 62 or governing mechanism may be deployed as illustrated in FIGS. 20-23 to dampen and stop rotation of contact arms 61*a* and 61*b* at a specified position. Illustrated in FIGS. 20 and 21 is a magnetic mechanism for dampening and stopping rotation of rotary head 60 around shaft 62. In FIG. 20 magnets 70*a* and 70*b* are embedded in stationary shaft 62 and magnets 71*a* and 71*b* are embedded in rotary head 60 with magnets 70*a* and 70*b* oriented to attract magnets 71*a* and 71*b*. Rotation is dampened by magnetic attraction and rotation ceases when the magnets are aligned and magnetic forces are maximal as illustrated in FIG. 21. In preparation for hitting and easy rotation, rotary head 60 is positioned with magnets maligned by 90 degrees for minimal magnetic attraction forces as shown in FIG. 20. Optionally, the subject may hit contact arm 61*a* or 61*b* when in position depicted in FIG. 21, which requires no repositioning of the contact arms 61 and 61*b* between hits, but more force is required to rotate rotary head 60.

Figure 23:
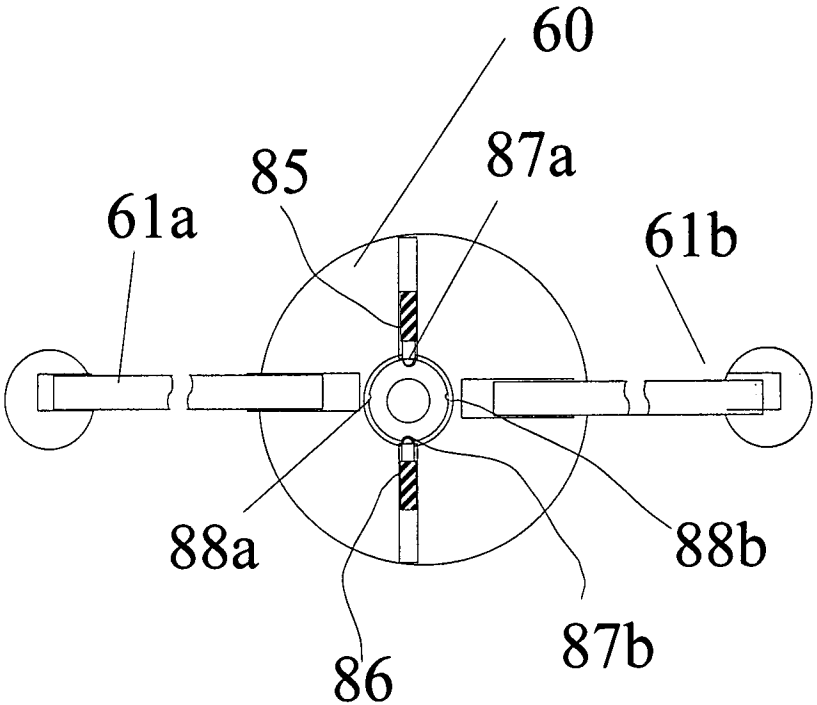
FIG. 23. Shows FIG. 22 in cross-sectional view with the contact arms rotated by 90 degrees and the roller balls in alignment with the deep recessions, the position that occurs when rotation stops.
Figure 22:
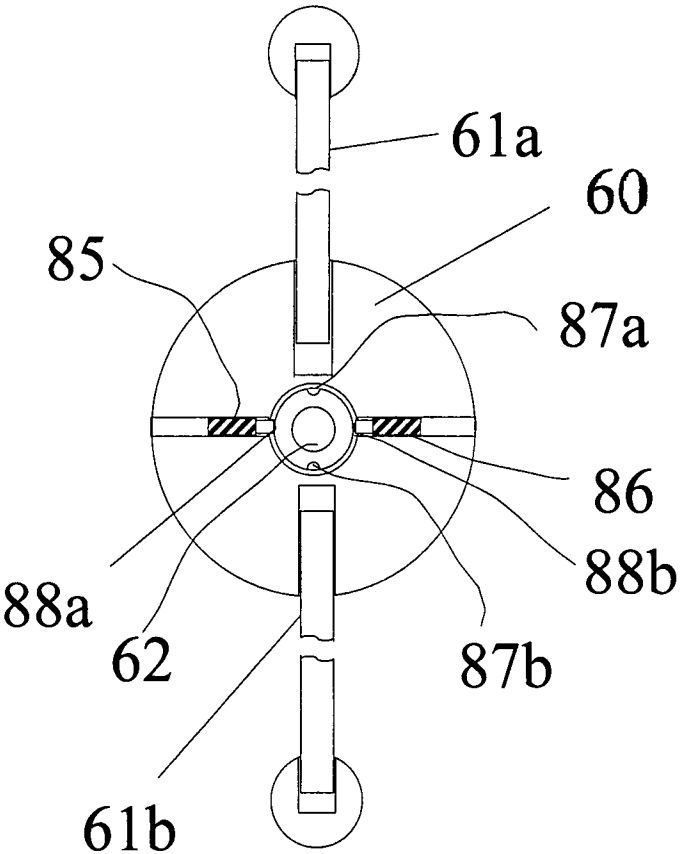
FIG. 22. Shows FIG. 18 in cross-sectional view with the alignment of the rotational governance roller balls in the preparatory position for hitting.
Figure 25:
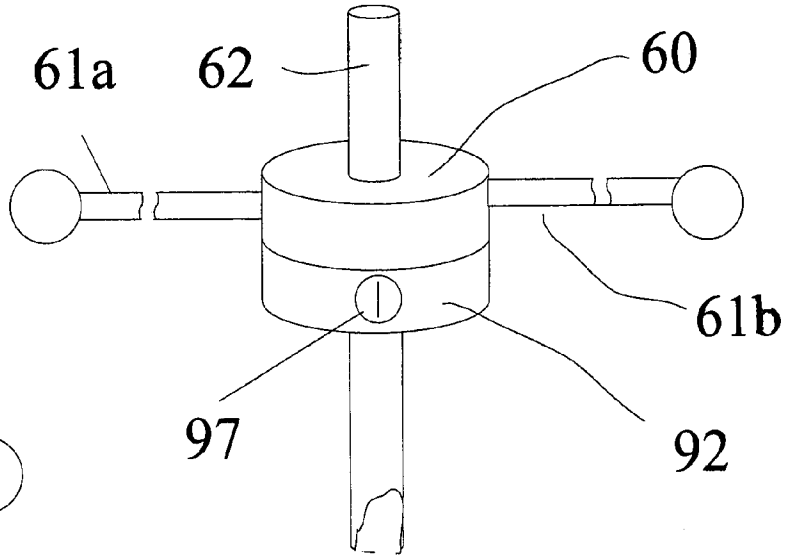
FIG. 25 Shows in perspective view revolving contact arms and the non-rotatable platform.

Another method for governing rotation is mechanical stops, for example, spring roller balls 85 and 86 as seen in FIGS. 22 and 23. When spring roller balls 85 and 86 are in alignment with deep recesses 87*a* and 87*b*, the revolving of rotary head 60 stops, the position illustrated in FIG. 23. When contact arms 61*a* or 61*b* are manually rotated to the starting position as illustrated in FIG. 22, positioning is maintained by the drag of balls 85 and 86 pressing into shallow recesses 88*a* and 88*b*. Optionally, the subject may hit contact arm 61*a* or 61*b* when in position depicted in FIG. 23, which requires no repositioning of the between attempted hits, but more force is required to move rotary head 60.

Figure 24:
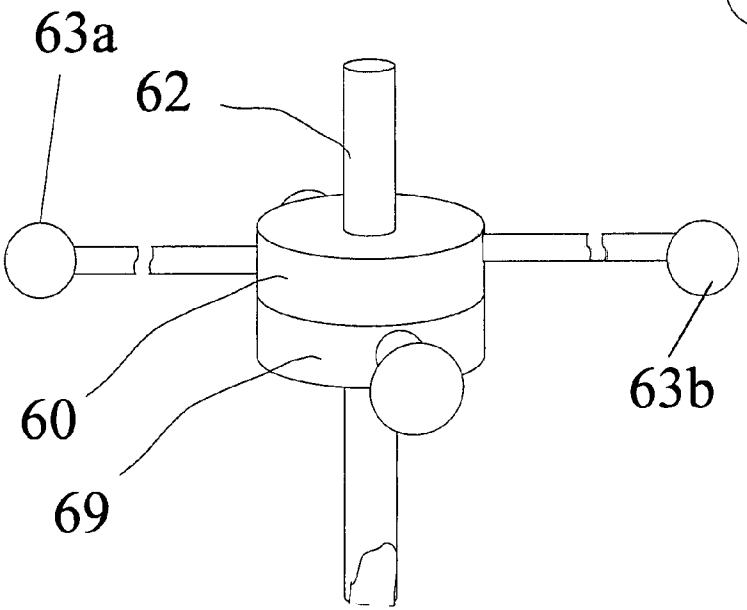
FIG. 24. Shows two stacked revolving contact arms in perspective view.

Two or more rotary heads, rotary head 60 and rotary head 69 with or without rotational governing mechanisms can be stacked on shaft 62 as illustrated in FIG. 24. The highest contact arm turned by the subject indicates the reaching height of the subject. Preferably blunt ends 63*a* and 63*b* are distinctive and possibly of different colors so that movement is easily noted.

Figure 27:
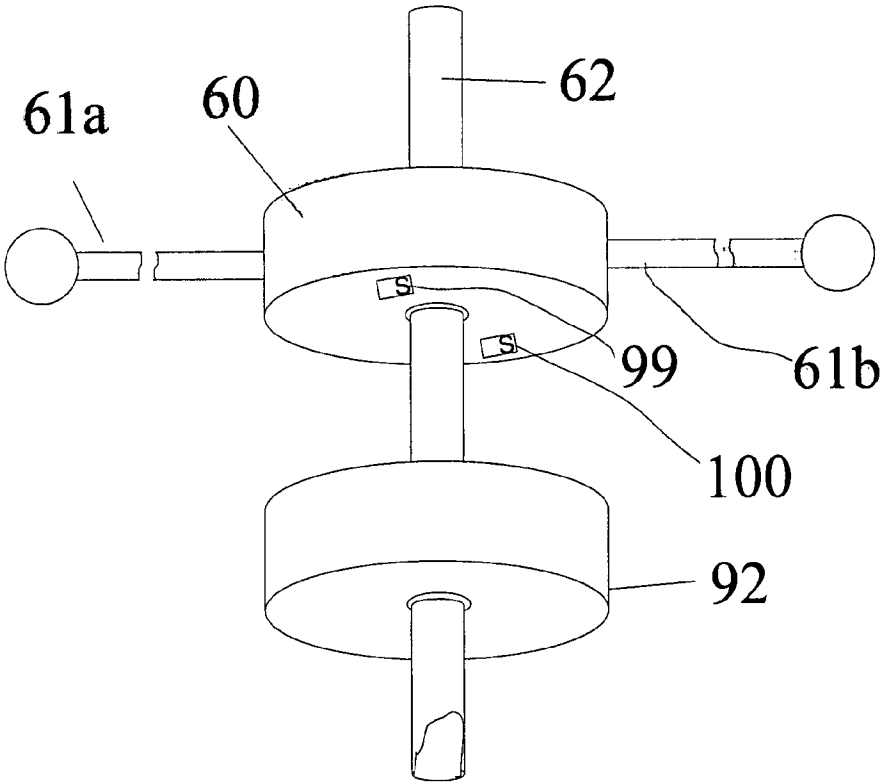
FIG. 27. Shows FIG. 25 in an expanded backward tilting perspective view illustrating the positions of the magnets.
Figure 26:
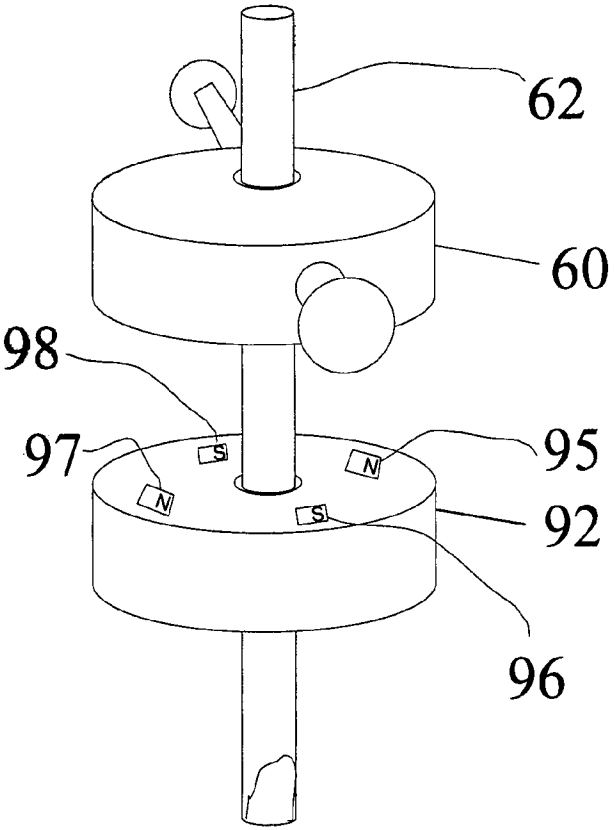
FIG. 26. Shows FIG. 25 in an expanded forward tilting perspective view illustrating the positions of the magnets.

In FIGS. 25-29 the rotary head 60 is in juxtaposition with stationary platform 92 which is fixed to shaft 62, with set screw 97. Between rotary head 60 and platform 92 may reside a motion governing mechanisms to dampen and stop the revolving of rotary head 60 after being set in motion by a force applied to contact arm 61*a* or contact arm 61*b*. The motion governing mechanism can be better understood by viewing FIGS. 26 and 27 where the space between rotary head 60 and platform 92 is expanded for purpose of illustration. In FIGS. 26 and 27, magnetic attraction exists between unlike poles of magnets 95 and 97 of platform 92 and magnets 99 and 100 of rotary head 60 and magnetic repellence exists between like poles magnets 96 and 98 of platform 92 and magnets 99 and 100 of rotary head 60. Because of magnetic attraction, rotary head 60 comes to rest when magnets 99 and 100 on rotary head 60 are aligned unlike poles magnets 95 and 97 of platform 92.

Figure 29:
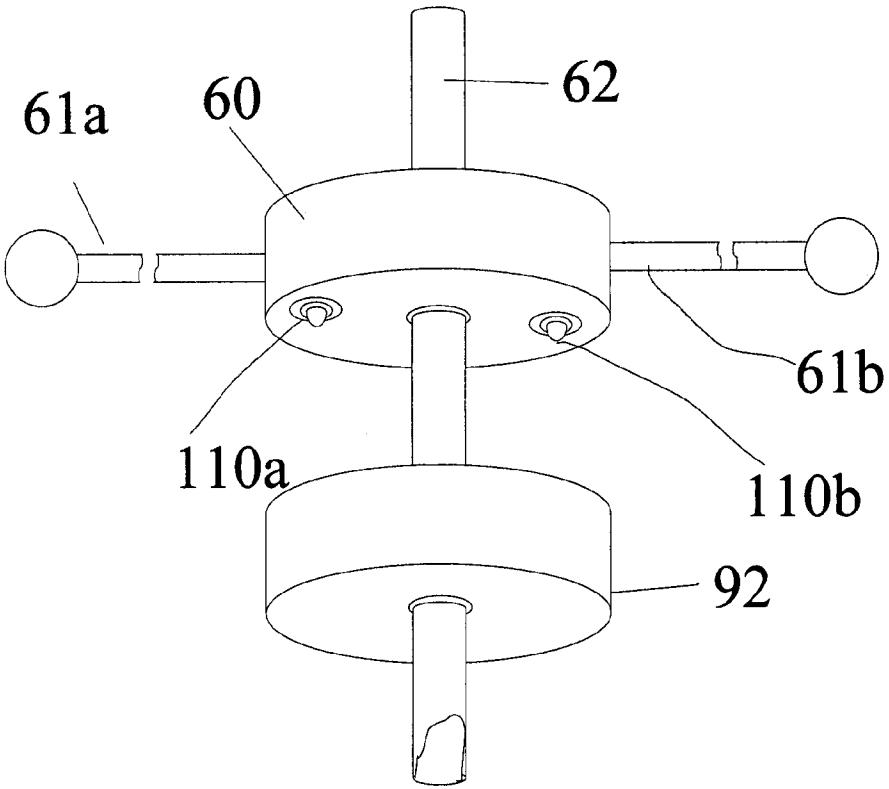
FIG. 29. Shows FIG. 25 in expanded backward tilting perspective view illustrating the positions of the spring roller balls.
Figure 28:
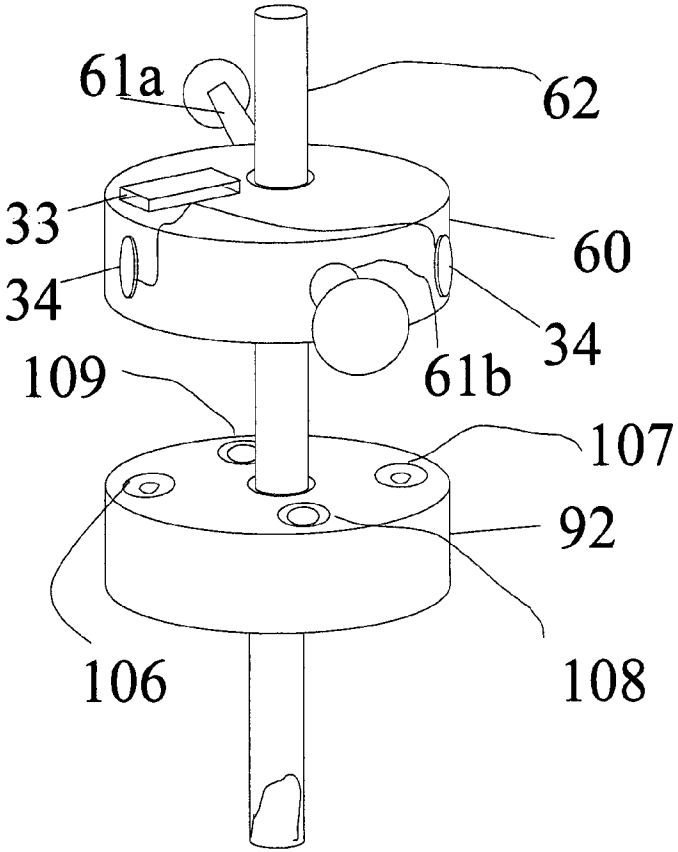
FIG. 28. Shows FIG. 25 in an expanded forward tilting perspective view illustrating the positions of the spring roller balls.

Another motion governing mechanism is illustrated in FIGS. 28 and 29. Between rotary head 60 and stationary platform 92 are mechanical stops, for example, spring roller balls 110*a* and 110*b* in FIG. 29 anchored into rotary head 60 dampens and stops rotation around shaft 62 by the friction generated when roller balls 110*a* and 110*b* (FIG. 29) seat into deep recesses 108 and 109 of stationary platform 92. Less deep recesses 106 and 107 (FIG. 28)*slow* rotation but cannot provide sufficient resistance to stop rotation of rotary head 60. However, recesses 106 and 107 do offer a foothold for holding rotary head 60 in the starting position in preparation for a reach-jump. When contact arm 61*a* and 61*b* are manually rotated to the starting position, positioning is maintained by the resistance of roller balls 110*a* and 110*b* (FIG. 29) resting in shallower recesses 106 and 107 (FIG. 28).

As illustrated in FIG. 28, motion sensor 33 which is triggered to activate blinking light 34, can be affixed to rotary head 60 to signal the motion generated by a successful reaching jump of a subject.

What is claimed is:

1. A machine for testing and training jumping and reaching ability comprising: a contact arm divided into a first and a second contact arm attached on opposite sides of a revolving platform that is rotatable in the horizontal plane with said platform fitting around a vertical shaft with said shaft supported by a base, fastened to the floor or volleyball antenna net, and where the means of dampening movement and stopping the rotation of said contact arms at a specific location is attractive magnetic force between said platform and said shaft with said force strategically positioned so that rotation of said contact arms stop at said specific location.

2. A machine of claim 1 where said means of dampening movement and stopping rotation of said contact arm is one or more mechanical stops positioned between said platform and said shaft that stops the rotation of said contact arms at said specific location.

3. A machine for testing and training jumping and reaching ability comprising: a contact arm that divided into a first and a second contact arm attached on opposite sides of a rotatable platform that is rotatable in the horizontal plane with said rotatable platform fitting around a vertical shaft that is supported by a base, fastened to the floor or a volleyball net antenna, a second non-rotatable platform fits around said vertical shaft so that said rotatable and said non-rotatable platforms are in juxtaposition, and where the means of ceasing movement between said rotatable platform and said non-rotatable platform for stopping rotation of said contact arms at a specific location is attractive magnetic force between said rotatable and non-rotatable platforms with said force strategically positioned so that rotation of said contact arms stops at said specific location.

4. A machine of claim 3 where said means of ceasing movement between said rotatable platform and said non-rotatable platform is at least one mechanical stop strategically positioned to stop rotation of said contact arms at said specific location.

5. A machine for testing and training jumping and reaching ability comprising a vertical shaft supported by a base, fastened to the floor or volleyball net antenna, a contact arm where said arm is divided into a first and a second contact arm with the proximal end of each of said contact arms having a rotating hinge attached to said shaft with said arms rotatable in the horizontal plane and where the means of repositioning of said contact arms to the starting position after being hit by a subject is an adjusting tension serpentine cord that exerts force onto the proximal ends of said contact arms.

6. A machine of claim 5 where the length of said shaft is adjustable and equipped with a scale, a measuring tape, or a electronic ruler that measures the altitude of said contact arm, whereby, the jump reaching height can be adjusted and measured.

7. A machine of claim 5 where said arm has holes that reduce the mass.

8. A machine of claim 5 where said means of repositioning of said contact arms to the starting position after being hit by a subject is a spring or other repositioning means that exerts force when stretched onto the proximal-ends of said contact arms.

* * * * *